United States Patent [19]

Jeter

[11] 4,319,649

[45] Mar. 16, 1982

[54] STABILIZER

[76] Inventor: John D. Jeter, P.O. Box 5236, Midland, Tex. 79701

[21] Appl. No.: 370,927

[22] Filed: Jun. 18, 1973

[51] Int. Cl.[3] ..... E21B 7/08

[52] U.S. Cl. ..... 175/73; 175/61

[58] Field of Search ..... 175/73–76, 175/61, 81, 79

[56] References Cited

U.S. PATENT DOCUMENTS

| | | | |
|---|---|---|---|
| 2,173,309 | 9/1939 | Monroe | 175/76 |
| 2,329,597 | 9/1943 | Diehl et al. | 175/73 |
| 2,712,434 | 7/1955 | Giles et al. | 175/73 |
| 2,890,859 | 6/1959 | Garrison | 175/76 |
| 2,919,897 | 1/1960 | Sims | 175/76 |
| 3,043,381 | 7/1962 | McNeely | 175/73 |
| 3,243,001 | 3/1966 | Vincent | 175/73 |
| 3,352,370 | 11/1967 | Livingston | 175/73 |

*Primary Examiner*—Ernest R. Purser

*Attorney, Agent, or Firm*—Vaden, Eickenroht, Thompson, Bednar & Jamison

[57] ABSTRACT

The stabilizer disclosed includes a body for mounting on the drill string and a sleeve for mounting on the body to engage the wall of the well bore. The body is mounted eccentrically of the longitudinal axis of the drill string and the sleeve is mounted eccentrically to the longitudinal axis of the body. The eccentricities of the body and the sleeve are equal so that when positioned where the eccentricities extend in the opposite direction, the sleeve will be centrally located with respect to the drill string and will tend to hold the drill string in the center of the well bore, whereas when the body and sleeve are rotated relatively so that the eccentricities of the two members accumulate, the sleeve will then be positioned with its longitudinal axis spaced from the longitudinal axis of the drill string and the sleeve will exert a lateral force on the drill string urging the drill string away from the center of the well bore.

28 Claims, 22 Drawing Figures

FIG. 1
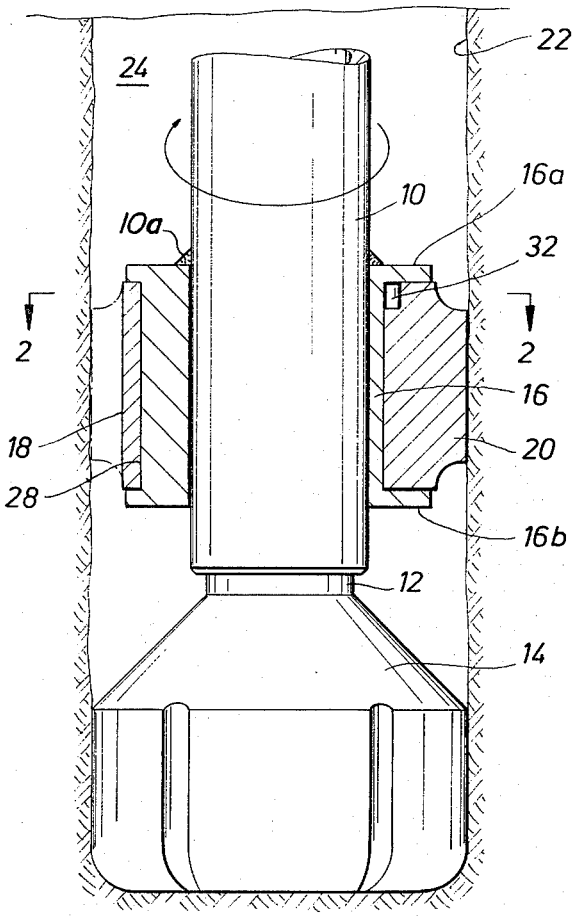
FIG. 3
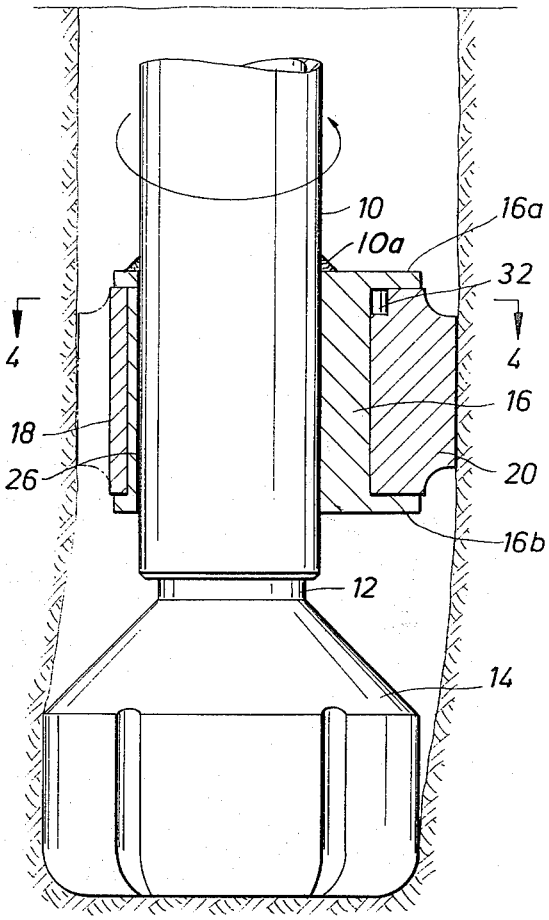
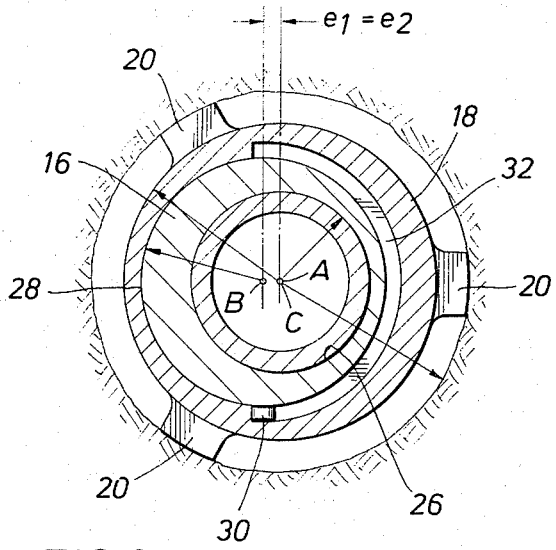
FIG. 2
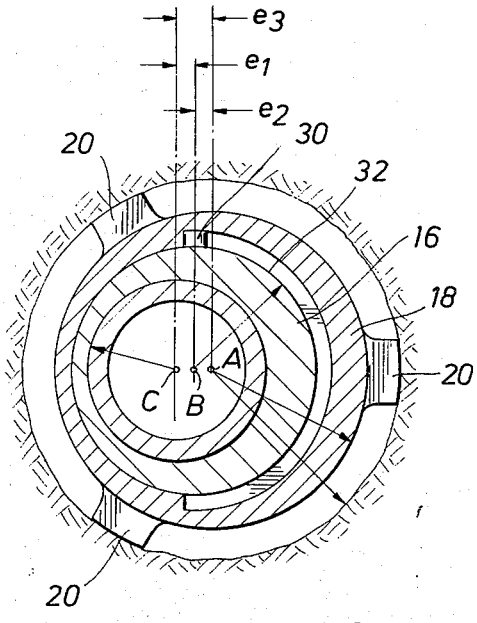
FIG. 4

FIG. 15
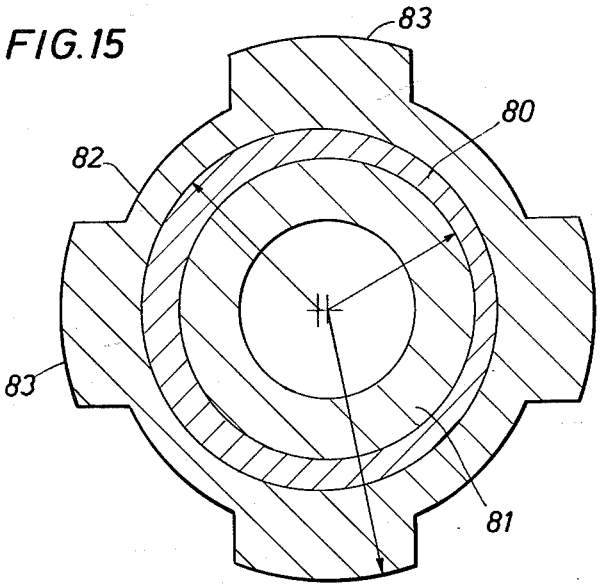
FIG. 16
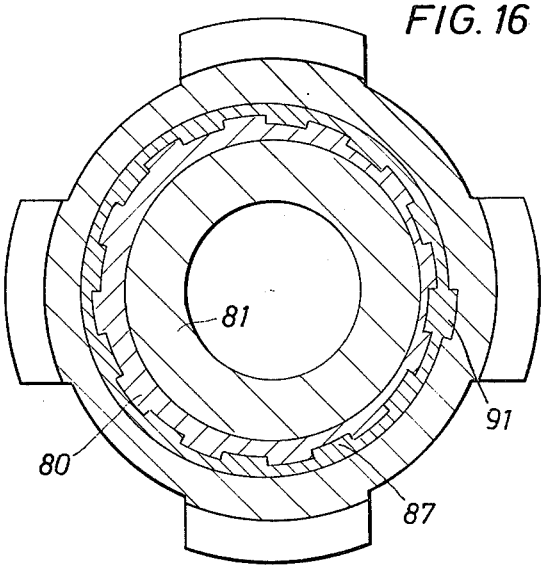
FIG. 17
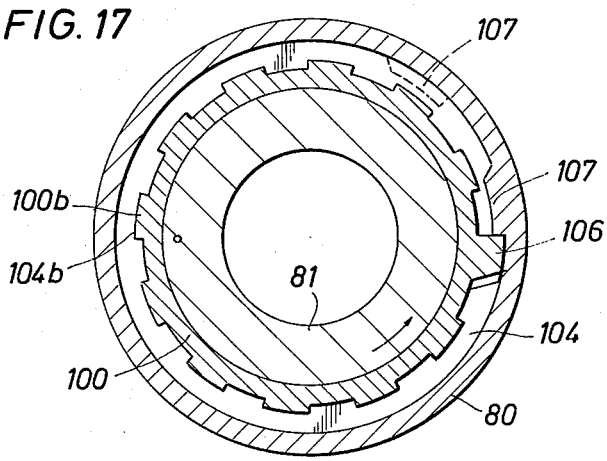
FIG. 18
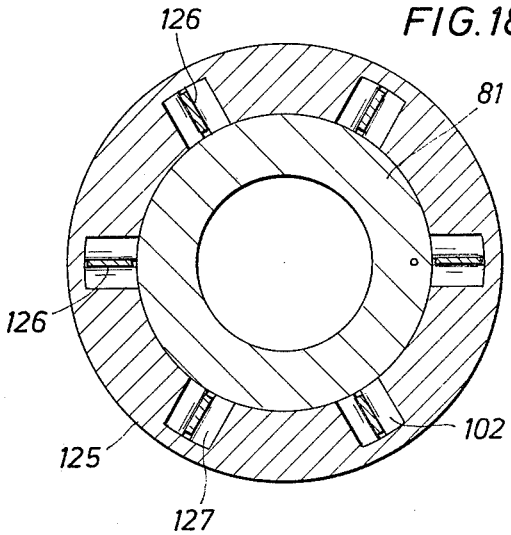
FIG. 20
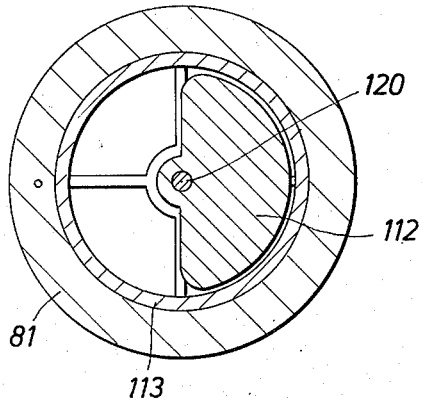
FIG. 19
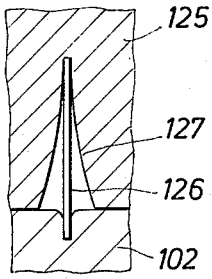
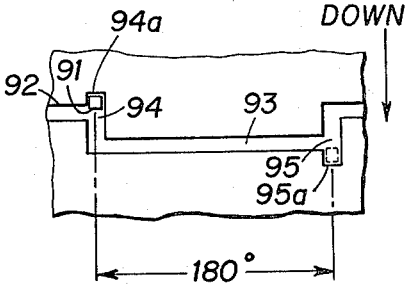
FIG. 21

STABILIZER

This invention relates to stabilizers for running on a drill string.

A stabilizer usually has laterally extending ribs or vanes that engage the wall of the well bore and hold the portion of the drill string adjacent the stabilizer away from the wall. They are used to help control the direction the bit takes as it drills through the ground. For example, depending on the number and location of the stabilizers in the drill string, they can be used to help keep a bit drilling in a given direction or cause it to tend to change directions. In each case, the bit will only tend to travel in the desired direction and may or may not do so.

To positively change the direction a bit is drilling, a lateral force is usually applied to the drill string near the bit. This is presently done by using a bent sub or a whipstock.The bent sub is used with a downhole motor. The sub is oriented to cause the bit to drill in the desired direction then held without rotation while the downhole motor below the sub rotates the bit. The whipstock allows relative rotation between the pipe string and the whipstock and, therefore, can be used without a downhole motor. With either tool, it is necessary to pull the pipe out of the hole after the hole has been deflected the desired amount to remove the bent sub or the whipstock.

It is an object of this invention to provide a stabilizer for use with a drill string that can be positioned selectively to either centralize the drill string in the well bore, or to exert a lateral force on the drill string to urge the bit to change its direction of drilling without having to remove the drill string from the well bore.

It is another object of this invention to provide a stabilizer for use with a drill string that employs a downhole motor to drive the bit wherein the direction of rotation of the drill string determines whether the stabilizer is holding the drill string in the center of the well bore or is eccentric to the longitudinal axis of the drill string so as to impose a lateral force on the drill string to urge the bit to change directions.

It is another object to provide such a stabilizer that includes a motor to selectively rotate the stabilizer between a position centralizing and a position urging the drill string laterally.

It is another object of this invention to provide a stabilizer for use with a drill string that can be positioned selectively to either centralize the drill string in the well bore, or to exert a lateral force on the drill string to urge the bit to change its direction of drilling without having to remove the drill string from the well bore and that can be locked in either position.

It is an object of this invention to provide a stabilizer that includes a body mounted eccentrically on the drill string and an outer sleeve mounted eccentrically on the body so by changing the position of the sleeve on the body, the sleeve can be positioned eccentric to the drill string by an amount up to the total eccentricity of the body and sleeve to exert a lateral force on the drill string.

It is another object of this invention to provide a stabilizer for a drill string that can be positioned to tend to centralize a rotating drill string in a well bore or to exert a lateral force on the rotating drill string in a predetermined direction relative to the low side of the well bore.

It is another object of this invention to provide a stabilizer for a drill string that can be controlled from the surface to centralize a drill string in the well bore or exert a lateral force on the drill string in a predetermined direction relative to the low side of the well bore and that will reorient the stabilizer should it drift away from the desired orientation.

These and other objects, advantages, and features of this invention will be apparent to those skilled in the art from a consideration of this specification, including the attached drawings and appended claims.

In the drawings:

FIG. 1 is a vertical sectional view through an embodiment of the stabilizer of this invention for use with a downhole motor, showing the stabilizer in position to urge the drill string toward the center of the well bore;

FIG. 2 is a cross-sectional view taken along line 2—2 of FIG. 1;

FIG. 3 is a view similar to FIG. 1, showing the stabilizer positioned to exert a lateral force on the drill string urging it out of alignment with the longitudinal axis of the well bore;

FIG. 4 is a sectional view taken along line 4—4 of FIG. 3;

FIG. 15 is a sectional view taken along line 15—15 of FIG. 14B;

FIG. 16 is a sectional view taken along line 16—16 of FIG. 14B;

FIG. 17 is a sectional view taken along line 17—17 of FIG. 14B;

FIG. 18 is a sectional view taken along line 18—18 of FIG. 14B;

FIG. 19 is a sectional view taken along line 19—19 of FIG. 14B;

FIG. 20 is a sectional view taken along line 20—20 of FIG. 14A; and

FIG. 21 is a layout of the guiding and locking grooves used with this embodiment.

Figure 5:
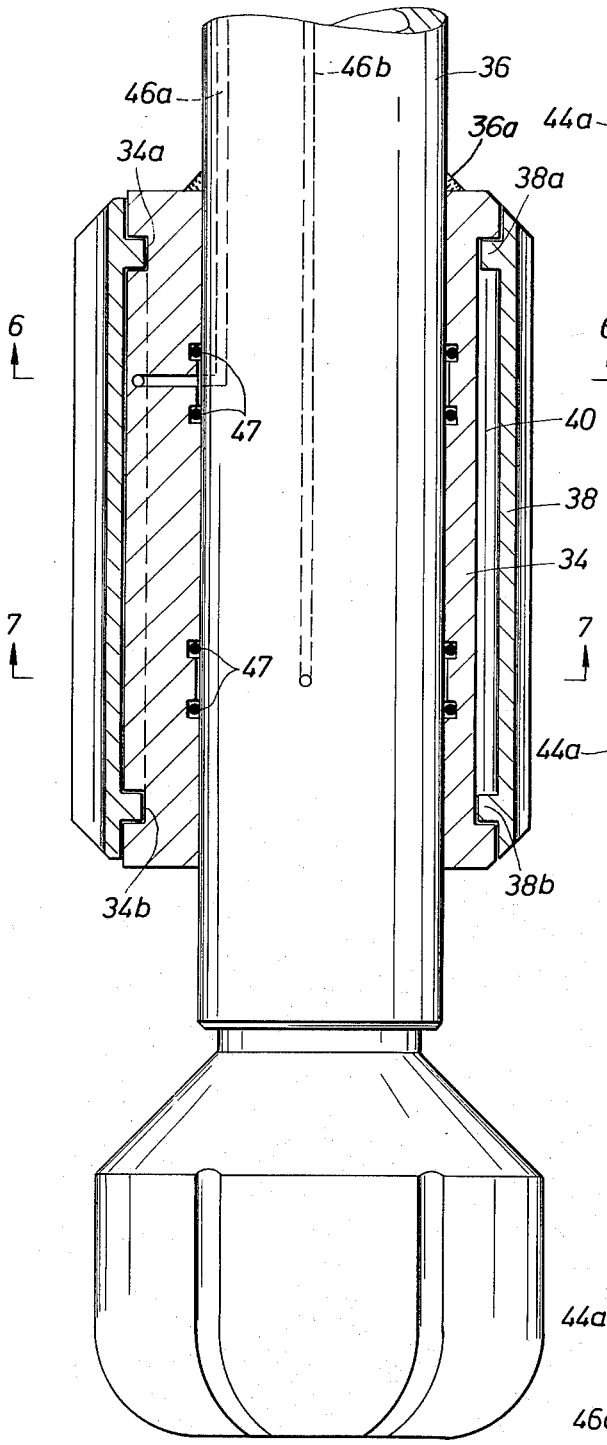
FIG. 5 is a vertical sectional view of an alternate embodiment of this invention also for use with a downhole motor.

The first three embodiments of the stabilizer of this invention that are shown in the drawings are designed for use in a drill string assembly that includes a downhole motor for driving the bit. Each downhole motor will have a stator section and a rotor section. The stator section is usually attached to the drill string and supported thereby, and the rotor section drives the bit. In FIG. 1, tubular member 10 is the outer housing of a downhole motor that is connected to and supported by the drill string (not shown). Output shaft 12 of the motor is connected to drill bit 14. The output shaft is rotated and in turn rotates the drill bit by power supplied to the downhole motor. The motor could be powered electrically. Most commonly, however, it is powered by the energy in the drilling mud pumped down the drill string from the surface. In the latter case, the motor may consist of a turbine having stationary and moving blades that are caused to rotate relative to each other by the flow of drilling mud through the turbine. This provides output shaft 12 with sufficient torque to rotate the drill bit. There is an equal and opposite reaction torque imposed on the stationary portion of the turbine, of course, and this reaction torque is imposed on the drill string. It is this inherent feature of downhole motors that is employed to select the position of the embodiment of the stabilizer shown in FIGS. 1–4 in a manner to be described below.

In the embodiment shown in FIGS. 1–4, the stabilizer includes body 16 and sleeve 18. Body 16 is supported by housing 10 of the downhole motor which is part of the drill string. As shown, the stabilizer is located adjacent drill bit 14, although it is understood that it could be located further up the drill string if desired. The body is mounted on housing 10 for rotation with the housing and consequently with the drill string in any convenient manner, as for example, by weld 10*a*. Sleeve 18 is mounted on body 16 for rotation relative to the body. As shown, body 16 has upper and lower annular flanges 16*a* and 16*b* that hold sleeve 18 in position on the body. The outer surface of sleeve 18 has integrally attached longitudinal ribs 20 that engage wall 22 of well bore 24. Longitudinally extending ribs are used to provide space between the sleeve and the wall of the well bore for the passage of the drilling mud flowing upwardly from the bottom of the hole to the surface. In the embodiment shown, three such ribs are used.

As best seen in FIGS. 2 and 4, body 16 is provided with opening 26 to receive housing 10 of the downhole motor. This opening, of course, is designed to allow this stabilizer to be slipped over the outside of the outer housing and to fit snugly thereon. Means (not shown) are provided to hold the body in position on the housing and to cause it to rotate with the housing. This can be done in any conventional well-known manner. Alternatively, the body could be an integral part of the motor housing.

In accordance with this invention, opening 26 is eccentrically positioned relative to the outside surface of the body, In other words, the longitudinal axis of opening 26, which is indicated in FIG. 4 by the letter "C", is parallel to and spaced from the longitudinal axis of the body, which is indicated by the letter "B" in the drawings. The amount of eccentricity is indicated by $e_1$. Of course, the longitudinal axis of the drill string coincides with the longitudinal axis of opening 26.

Sleeve 18 is provided with a central opening 28 to receive body 16. As in the case of opening 26, opening 28 is just slightly larger in diameter than the outer diameter of body 16 to provide a good snug fit between the two members, but to allow relative rotation therebetween. In accordance with this invention, the longitudinal axis of opening 28, which is the same as longitudinal axis B of the body, is parallel to, but spaced from, longitudinal axis A of sleeve 18. The amount of eccentricity of the sleeve relative to the body is indicated by $e_2$.

Referring now to FIG. 4, body 16 has been rotated relative to sleeve 18 so that eccentricity $e_1$ of the body and eccentricity $e_2$ of the sleeve extend in the same direction from the centerline of the drill string, as indicated by longitudinal axis C.

In other words, in the position shown in FIG. 4, housing 10 and body 16 are rotated so that longitudinal axis B of the body is positioned to the right, as shown in the drawing, of longitudinal axis C which is the longitudinal axis of the drill pipe. In addition, sleeve 18 is positioned so that the longitudinal axis of the sleeve, which is axis A, is to the right also of the longitudinal axis of the drill pipe C, and this results in the longitudinal axis of the drill pipe, axis C, being displaced from the longitudinal axis of the stabilizer (axis A of the sleeve), by the distance $e_3$, the sum of $e_1$ and $e_2$. In this position, as shown in FIG. 3, with ribs 20 engaging the walls of well bore 24, the drill string is urged laterally away from the longitudinal axis of the well bore and the bit will tend to drill in that direction.

In FIG. 2 the stabilizer is positioned to tend to centralize the drill string in the well bore, i.e., the longitudinal axis of the drill string coincides with the longitudinal axis of sleeve 18. This is accomplished by positioning body 16 relative to sleeve 18 so that the eccentricities of the two members cancel out, resulting in the longitudinal axis of the drill pipe, which is axis C, coinciding with the longitudinal axis of the sleeve, which is axis A. In this position, the stabilizer will tend to centralize the drill string relative to the well bore if the well bore is not too far out of gage.

The stabilizer can be positioned with the longitudinal axis of the sleeve coinciding with the longitudinal axis of the pipe string because the two eccentricities, $e_1$ and $e_2$, are equal and will cancel out when the sleeve and body are positioned as shown in FIG. 2. If desired, the eccentricities could be different so that there would always be some eccentricity between the sleeve of the stabilizer and the centerline of the drill string. Also, whether the eccentricities are equal or not, the sleeve could be positioned on the body to be eccentric of the centerline of the drill string by any desired amount up to the total of the two eccentricities.

To select the position of the stabilizer from the surface during drilling operations, means are provided to limit the relative rotation of the sleeve in the body between first and second predetermined positions. In the embodiment shown, the stabilizer can rotate between a first position where the eccentricities cancel out, and a second position where the eccentricities are additive to cause the stabilizer to urge the drill string away from the longitudinal axis of the well bore.

In the embodiment shown, such means include lug 30, which is attached to the outside surface of body 16 and extends into groove 32 formed on the inside surface of sleeve 18. The groove extends slightly more than 180 degrees in this embodiment since it is desired to move from zero effective eccentricity, that is, where the eccentricities of the two members making up the stabilizer cancel out, to a position to where they are cumulative to provide the maximum eccentricity to the stabilizer. This requires 180 degrees of rotation of lug 30 relative to the groove, and since the lug has width the groove must extend for somewhat more than 180 degrees of arc.

To position the stabilizer in its first position where it tends to hold the drill string in the center of the well bore, the drill string is rotated in one direction. To move the stabilizer to the second position, the drill string is rotated in the opposite direction. In the normal drill string, the threaded connections are right hand threads, and therefore the drill string is normally rotated to the right so that the tendency will be to make up the connections rather than to unscrew them. Therefore, in the embodiment shown, with sleeve 18 being held against rotation by the engagement of ribs 20 with the wall of the well bore, right hand rotation of the drill string, as shown in FIG. 1, will cause lug 30 to move into the position shown. Further rotation will cause the sleeve to rotate with the body and the drill string as it is rotated to the right. Normally, when using downhole motors, such as turbines, the drill string is rotated very slowly to the right to help reduce the tendency of the pipe to become stuck in the well bore.

When it is desired to exert a lateral force on the drill bit, the reaction torque mentioned above produced by the downhole motor can be used to allow the drill string to rotate to the left. As the drill string rotates to the left, lug 30 will move 180 degrees to the position shown in FIG. 4 where the lug engages the other end of the groove. Now the eccentricities of the members are as shown in FIG. 4, and a lateral force is being imposed on the drill string adjacent the bit.

Usually, it is desirable to exert this force in a known direction since, in most cases, it will be exerted in an effort to bring the well bore back to a desired direction. Therefore, when the stabilizer is in its second position of FIG. 4, the pipe will usually not be rotated after the stabilizer has been oriented to exert the force in the desired direction. Then, after the well bore has come back and is now proceeding in the desired direction, the drill pipe can be rotated to the right and the stabilizer will be returned to its conventional centralizing mode of operation.

In the embodiment described above, relative rotation between the body and sleeve of the stabilizer was obtained by using the frictional engagement between the longitudinal ribs of the sleeve and the well bore to hold the sleeve against rotation to allow the body to be rotated relative thereto. Since well bores vary in diameter depending on the formation, and may be larger in diameter than the stabilizer in soft formations, it may be desired to provide the stabilizer with power means to rotate the sleeve relative to the body between the desired positions. Such power means are included in the embodiment shown in FIGS. 5 through 8 of the drawings.

Figure 6:
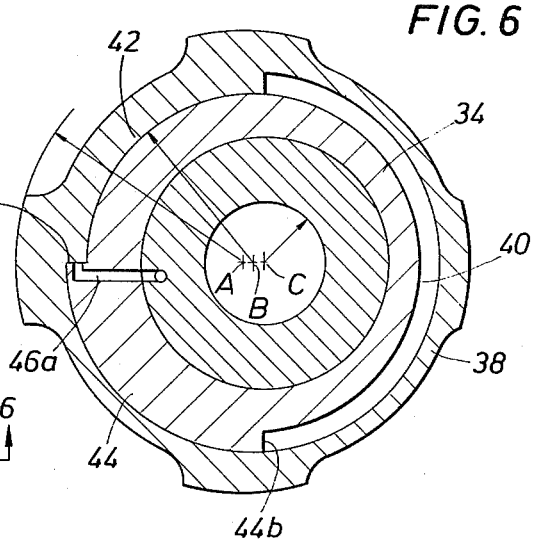
FIG. 6 is a sectional view taken along line 6—6 of FIG. 5.

Stabilizer body 34 is mounted on housing 36 of a downhole motor in any convenient way to rotate with the motor housing and the drill pipe as for example, by weld 36*a*. As in the previous embodiment, the body is mounted eccentrically on housing 36 with its longitudinal axis B eccentric and offset from the longitudinal axis C of the housing and the drill string. Outer sleeve 38 is mounted for rotation relative to body 34 and it is mounted eccentric to the body with its longitudinal axis A spaced from the longitudinal axis B of the body, as shown in FIG. 6. The sleeve is supported for rotation relative to the body by inwardly extending flanges 38*a* and 38*b* that engage annular grooves 34*a* and 34*b* in body 34.

As explained above, in this embodiment means are provided to rotate the sleeve relative to the body so that a stabilizer can be positioned without depending upon the frictional drag of the sleeve against the walls of the well bore. In the embodiment shown, the outer diameter of body 34 is reduced for approximately 270 degrees of arc to provide arcuate cavity 40 between the body and the sleeve. The internal diameter of sleeve 38 is reduced for approximately 90 degrees of arc to form piston 42 that extends into arcuate cavity 40. Arcuate portion 44 of the body provides end walls 44*a* and 44*b* of cavity 40 to limit the arcuate movement of piston 42 in the cavity.

Figure 7:
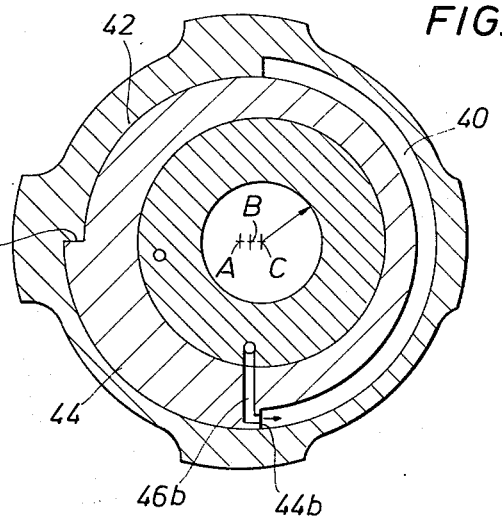
FIG. 7 is a sectional view taken along line 7—7 of FIG. 5.
Figure 8:
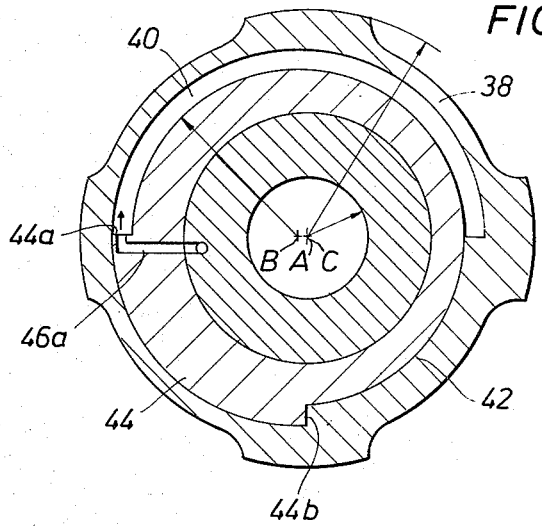
FIG. 8 is the same view as FIG. 6 with the outer sleeve rotated 180 degrees.

Means are provided to supply cavity 40 with fluid under pressure to move the outer sleeve between the first position where the stabilizer is tending to hold the drill string in the center of the well bore and a second position where the stabilizer is exerting a lateral force on the drill string. In the embodiment shown, passageway 46*a* extends downwardly through the wall of housing 36, then laterally to be connected to cavity 40 through end wall 44*a*, as shown in FIG. 6. Passageway 46*b*, in turn, extends downwardly through the wall of housing 36 and is connected to cavity 40 through end wall 44*b*, as shown in FIG. 7. If body 34 is not an integral part of housing 36, then suitable seals, such as O-rings 47, can be used to retain fluid in the passageways until it reaches the cavity.

Any means desired can be used to select which of passageways 46*a* or 46*b* will be supplied with fluid pressure. For example, a system as described in U.S. Pat. No. 2,924,432, which issued Feb. 9, 1960, and is entitled "Earth Borehole Logging System", has apparatus for operating downhole equipment and could be used to open and close valves to alternately pressure one or the other of passageways 46*a* and 46*b*.

In operation, assume that it will be desired to maintain the stabilizer in position to center the drill string in the well bore most of the time. Therefore, the body and the sleeve should be rotated to the position shown in FIG. 8 where the eccentricities cancel out as explained above. To do this, pressure fluid is supplied to passageway 46*a*. The pressure of the fluid moves piston 42 and sleeve 38 around cavity 40 until the piston engages end wall 44*b* of the cavity. When it is desired to exert a lateral force on the drill string, passageway 46*b* is supplied with fluid under pressure, and as shown in FIG. 7, piston 42 will be rotated in a counterclockwise direction until the piston engages wall 44*a*. In this position, as shown in FIGS. 6 and 7, the eccentricities combine to space the centerline of the stabilizer, indicated by the letter A, from the centerline of the drill string, indicated by the letter C, by the distance of both of the eccentricities of the body and the sleeve. With this arrangement, then, a positive force can be supplied to the stabilizer to move it to the desired position to insure that the stabilizer does so move thus eliminating the need to rely on the frictional drag between the outer sleeve and the wall of the well bore to cause the desired rotation.

Figure 9:
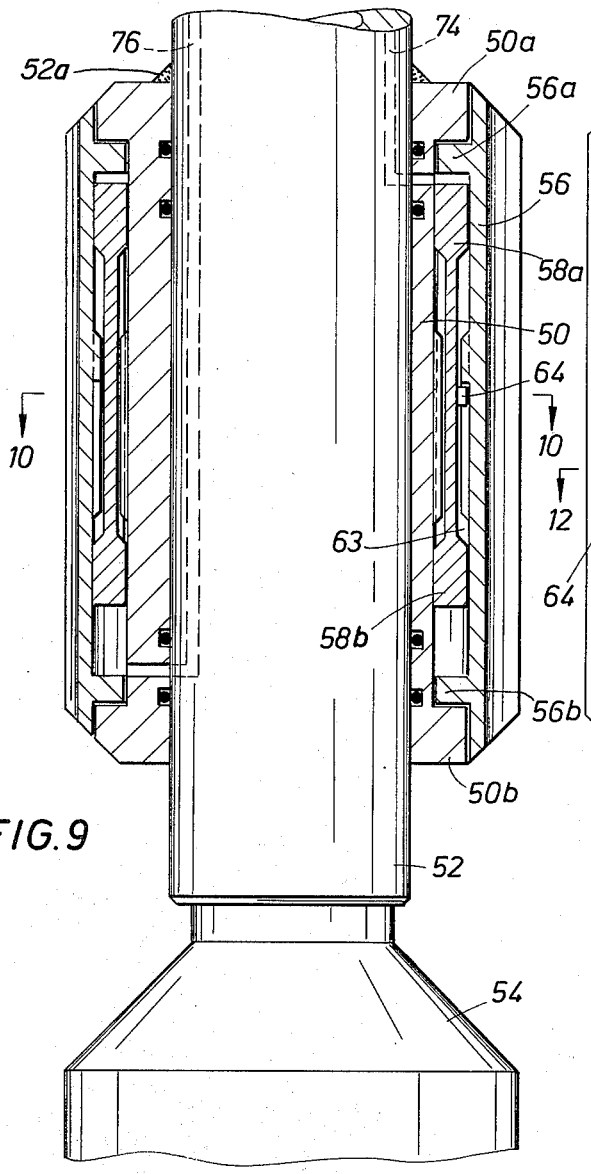
FIG. 9 is a vertical sectional view of another embodiment of this invention also for use with a downhole motor.
Figure 11:
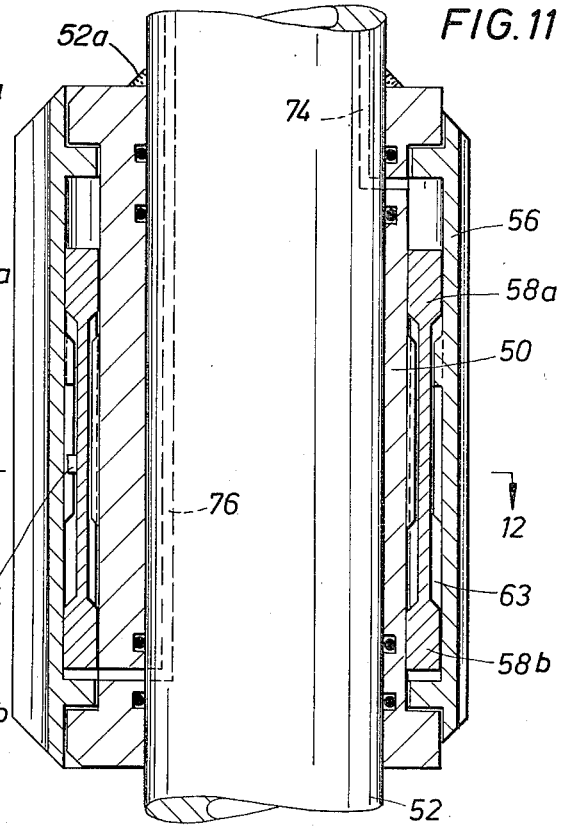
FIG. 11 is a view similar to FIG. 9 with the outer sleeve rotated 180 degrees.
Figure 12:
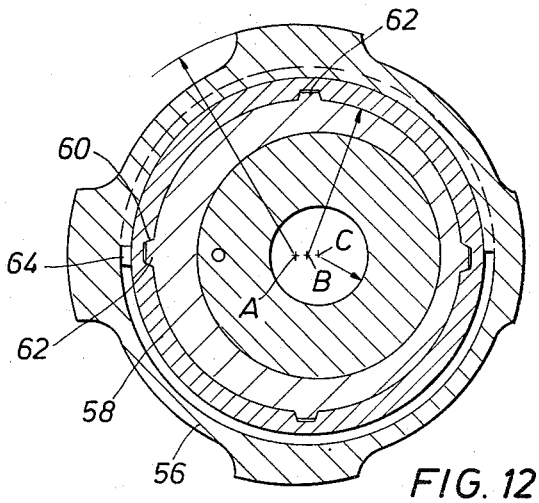
FIG. 12 is a sectional view taken along line 12—12 of FIG. 11.
Figure 10:
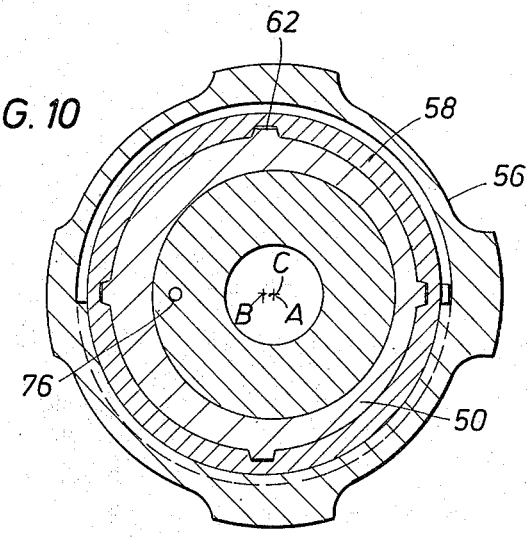
FIG. 10 is a sectional view taken along line 10—10 of FIG. 9.

It may be desirable to lock the stabilizer in either its position centralizing the drill pipe in the well bore or its second position where it is holding the drill string eccentric to the centerline of the well bore. In the embodiment shown in FIGS. 9 through 13, means are provided to lock the stabilizer in either position. Here, body 50 is supported by the drill string by being attached to housing 52 of a downhole motor used to drive bit 54 by weld 52*a*. Sleeve 56 is mounted for rotation relative to body 50 by inwardly extending flanges 56*a* and 56*b* that are located between end flanges 50*a* and 50*b* of the body. The sleeve and body are both designed to have eccentricities in the manner described above in connection with the two previous embodiments so that they will centralize the drill string relative to the well bore in one position, as shown in FIGS. 9 and 10, and will tend to urge the centerline of the drill string laterally of the centerline of the well bore in a second position, as shown in FIGS. 11 and 12.

As explained above, means are provided to lock the stabilizer in the desired position. In the embodiment shown, locking member 58 comprises an annular member located between the body and the sleeve. The locking member has internal grooves 60 that receive longitudinally extending ribs or splines 62 on the body. Thus, locking member 58 and body 50 cannot rotate relative to each other, but the locking member can move longitudinally of the body along splines 62. The locking member and the splines are located in cavity 63 provided between the body and sleeve and extending longitudinally between flanges 56*a* and 56*b* of the sleeve.

Attached to locking member 58 is locking pin or lug 64 that extends into an internal circumferential groove in sleeve 56. The groove arrangement is shown diagrammatically in FIG. 13. It consists of first groove 66 and second groove 68. The two grooves are not in horizontal alignment. The adjacent ends of the grooves are connected by vertically extending grooves 70 and 72. In the case of connecting groove 70, it extends above groove 66 for a distance to provide pocket 70*a* and in the same manner connecting groove 72 extends below groove 68 to provide pocket 72*a*. As stated above, pin 64 extends into and engages this pattern of grooves. Consequently, if pin 64 is located in groove 66 it can move the length of this groove in either direction, but cannot enter groove 68 unless it is moved vertically downward after it reaches the end of groove 66. Conversely, the pin can travel in groove 68 but cannot reach groove 66 unless it is moved upwardly. To control the position of pin 64 so that the stabilizer can be locked in either of the two selected positions, means are provided to urge the locking pin upwardly when it is desired to lock the stabilizer in the first position, as shown in FIGS. 9 and 10, and to urge the locking pin downwardly when it is desired to lock the stabilizer in the second position, as shown in FIGS. 11 and 12.

Referring again to FIG. 13, when locking pin 64 is urged upwardly, and assuming it is in groove 66, rotation of the body relative to the sleeve will carry the locking member and the pin with it and cause the pin to move to the right in groove 66, and being urged upwardly the lug will move into pocket 70*a* and stop any further relative rotation of the sleeve and the body. As long as locking pin 64 is in this position in pocket 70*a*, the stabilizer will be locked in the first position. When it is desired to move the stabilizer to the second position, means are provided to urge the locking pin downwardly, which will cause the pin to move down through connecting passageway 70 into groove 68, then relative rotation can occur between the sleeve and the body and the pin will move to the right until it is moved into pocket 72*a* again locking the sleeve and body of the stabilizer against further rotation. To move the stabilizer back to its first position, the means for urging the lug to move upwardly are actuated and the pin will move upwardly through passageway 72 back into passageway 66 where relative rotation can again occur until the lug reaches pocket 70*a* and again the stabilizer will be locked in the first position. In accordance with the preferred embodiment of this invention, the pin will move approximately 180 degrees between the locking pockets 70*a* and 72*a*.

Figure 13:
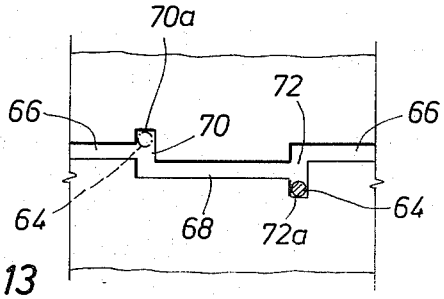
FIG. 13 is a layout in the plane of the drawing of the circumferential grooves employed in the embodiment of FIGS. 9 and 11.

In the embodiment shown, the means urging the lug upwardly or downwardly, as the case may be, includes first piston 58*a* attached to the upper end of locking member 58, and second piston 58*b* attached to the lower end of locking member 58. Passageway 74 extends downwardly from control valve apparatus (not shown) located above and through body 50 into cavity 63 above piston 58*a*. Conversely, passageway 76 is connected through the body into the cavity below piston 58*b*. As explained above, using downhole control equipment, such as that described in the above mentioned U.S. Pat. No. 2,924,432, passageways 74 and 76 can be selectively supplied with fluid under pressure. When passageway 74 is supplied with pressure, it will act against piston 58*a* and urge locking member and pin 64 downwardly which would move the pin from pocket 70*a*, as shown in FIG. 13, into groove 68 and allow the relative rotation required to move the stabilizer to the position shown in FIGS. 11 and 12. Conversely, to move back and get the locking pin out of pocket 72*a*, passageway 76 is provided with fluid under pressure to urge the pin upwardly and back to the position shown in FIG. 9 after the sleeve is rotated 180 degrees relative to the body.

If desired, resilient means, such as a coil spring, could be positioned to urge locking member 58 in one direction. Pressure would be used to compress the spring and move the locking member to allow the sleeve to rotate to another position. When the pressure is released, the sleeve would be free to rotate again until locked in the original position relative to the body by pin 64.

It may be desirable or necessary to lock the stabilizer only when the stabilizer is in one position. In this case, grooves 66 and 68 can be axially aligned to form one continuous circumferential groove with one of either pockets 70*a* and 72*a* to lock the sleeve in the desired position.

In the drawings, the stabilizer has been shown located adjacent the bit. Alternatively, it could be located well above the bit with a conventional centralizing type stabilizer located between the eccentric stabilizer and the bit. With this arrangement, when the eccentric stabilizer is exerting a lateral force on the drill pipe, the force on the bit would be in the opposite direction since the conventional stabilizer between the bit and the eccentric stabilizer would act as a pivot point or fulcrum, causing the bit to move in the opposite direction from the direction the eccentric stabilizer is urging the drill pipe. There may be occasions where this is the desired arrangement.

The above embodiments of the stabilizer of this invention are primarily designed for use with downhole motors where the drill pipe can be held stationary while drilling continues. In the embodiment shown in FIGS. 14–21, the unique eccentric stabilizer described above is arranged for use in a drill string where the drill bit is rotated directly by the drill pipe.

Figure 14A:
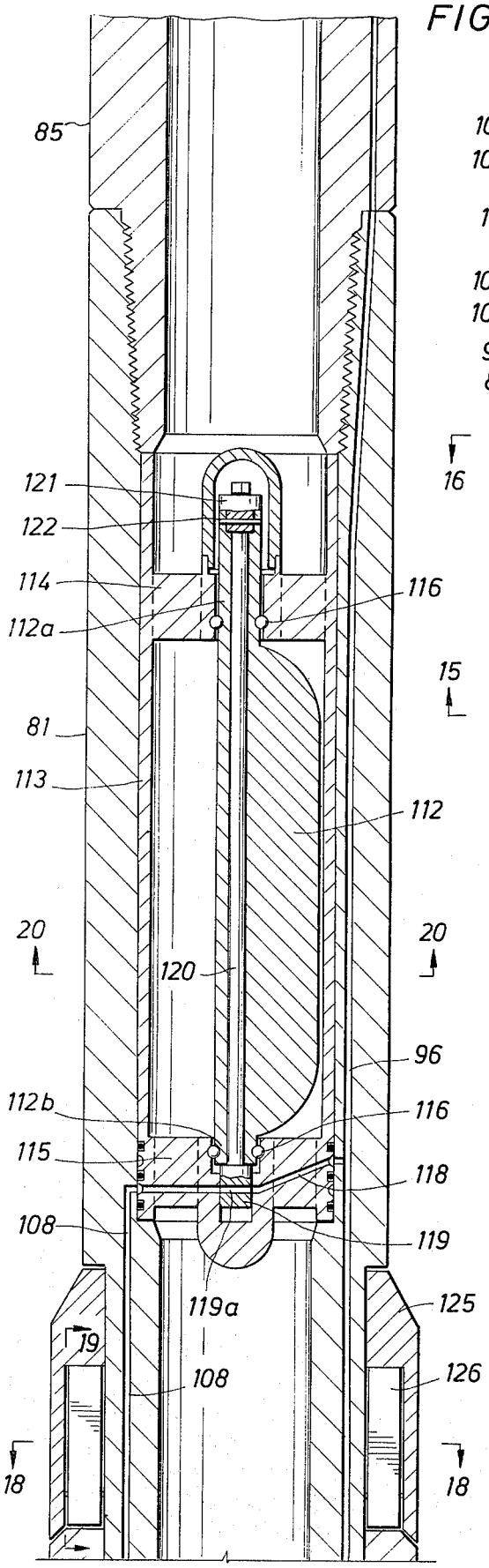
FIGS. 14A and 14B are vertical sectional views through another embodiment of this invention.
Figure 14B:
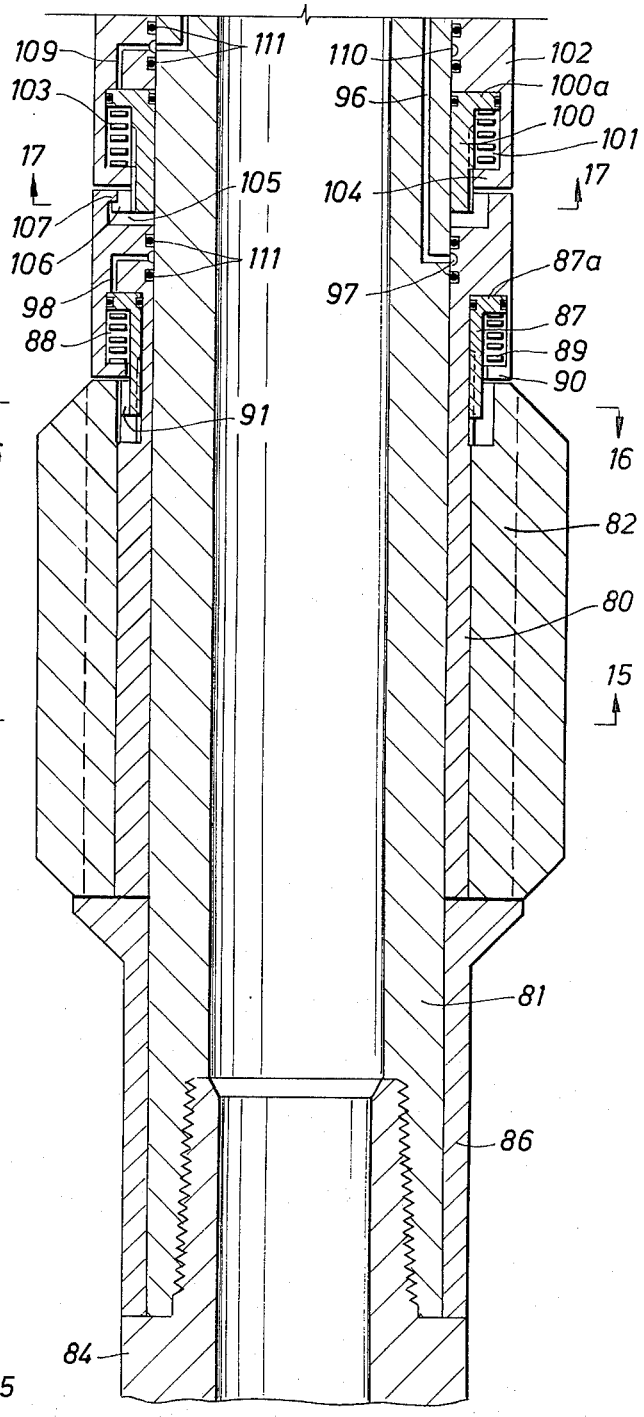

As best seen in FIGS. 14B and 15, the stabilizer in this embodiment includes body 80 which is mounted eccentrically on tubular member 81. Sleeve 82 is mounted eccentrically of body 80 in the manner described above in the previous embodiments whereby the position of the sleeve on the body will determine the total eccentricity between the longitudinal axis of the drill string and that of outer sleeve 82. In the embodiment shown, the eccentricities are arranged so that in a first position the eccentricities will cancel out and ribs 83 will engage the wall of the well bore and tend to centralize the drill string in the well bore. The sleeve is also movable to a second position where the eccentricities are cumulative to provide a lateral force on the drill string in the manner described above.

Tubular member 81 is adapted to be connected directly into the pipe string as shown, and its longitudinal axis coincides with the longitudinal axis of the drill string. It is connected at its lower end to tubular member 84 which could be anywhere in the drill string depending on the desires of the operator. If it is desired to exert the lateral force of the stabilizer close to the bit, then member 84 would normally be either the upper portion of the drill bit itself or the bit sub. At its upper end it is connected to tubular member 85 which connects the assembly into the drill string that extends above.

In this embodiment, body 80 is mounted to freely rotate on tubular member 81 so that the body can stand still while the drill pipe rotates. Tubular spacer 86 extends over the lower portion of member 81 and limits the downward movement of the body and the sleeve of the stabilizer while allowing the relative rotation between the body and member 81.

As with the embodiments described above, the eccentricity between the sleeve of the stabilizer and the longitudinal axis of the drill string will depend upon the relative positions of the sleeve on the body. Probably, in most instances, it will be desirable to have the sleeve movable between only two positions, a first position where the eccentricities cancel out so that the stabilizer acts as a conventional stabilizer tending to hold the drill pipe in the center of the well bore, and a second position where the eccentricities are cumulative to cause the stabilizer to tend to exert a lateral force on the drill string.

In the embodiment shown in FIGS. 14–21, means are provided to lock the stabilizer in the desired position. Such means include annular piston 87 that is located in annular cavity 88 formed in body 80 above outer sleeve 82, as shown in FIG. 14B. As best seen in FIG. 16, piston 87 and body 80 have engaging splines that allow movement of the piston longitudinally of body 80 but causes the piston to rotate with the body. Spring 89 is positioned between flange 87*a* of the piston and inwardly extending flange 90 to urge piston 87 upwardly to the position shown in FIG. 14B. On the lower end of the piston is outwardly extending tang or lug 91 that extends into a grooved path formed on the inner surface of outer sleeve 82. The layout of this grooved path is shown in FIG. 21. It consists of two spaced parallel grooves 92 and 93 that extend transverse the longitudinal axis of the sleeve and drill string. Each groove extends slightly more than 180 degrees and they are located to slightly overlap. The adjacent ends of the grooves are connected by grooves 94 and 95 that are parallel to the longitudinal axis of the sleeve and drill string. Both grooves 94 and 95 extend beyond the point of intersection with the grooves 92 and 93, respectively, to form pockets 94*a* and 95*a*. With piston 87 in the up position, as shown in FIG. 14B, the position to which it is urged by coil spring 89, sleeve 82 will rotate relative to body 80 until lug 91 moves into pocket 94*a*, as shown in FIG. 21. This will lock the outer sleeve and the body against further relative rotation and can be selected for one of the desired positions of the sleeve relative to the body.

Assume, for example, that in this relative position the stabilizer is in the concentric mode where it is acting as a conventional stabilizer urging the longitudinal axis of the drill string toward the center of the wall bore. No provision is made for forcing relative rotation between the sleeve and body to move the lug to this position. As the drill pipe rotates body 80, however, there will be enough frictional drag between ribs 83 on the sleeve and the wall of the well bore to keep sleeve 82 from rotating with the body. Therefore, relative rotation can be produced between the sleeve and the body by the rotation of the drill string. This relative rotation will occur until the lug moves into pocket 94*a*, as explained above, and in this position the stabilizer will be in one of its selected positions which, for our purposes here, has been selected as the concentric mode of operation.

When it is desired to exert a lateral force on the drill string, means are provided to release the body and sleeve for further relative rotation so that they can move to the eccentric mode of operation. In the embodiment shown, member 81 is provided with passageway 96 that extends downwardly through its wall and connects with annular groove 97 on the inner surface of body 80 above piston 87. The annular groove is connected to the upper end of chamber 88 in the body by passageway 98. Thus, by supplying fluid under pressure to passageway 96, the pressure will act against the upper surface of piston 87 and move the piston downwardly overcoming the resistance of spring 89. This downward movement will cause lug 91 to move downwardly in groove 94 (FIG. 21), into groove 93. At this point, relative rotation between the sleeve and the body can again occur for the reasons explained above, and the body will rotate relative to the sleeve until lug 94 reaches the end of groove 93 and enters vertical groove 95. Continued downward force on the piston will move the lug into pocket 95*a* (shown dotted in FIG. 21), and again lock the body and sleeve against further relative rotation. The length of grooves 92 and 93 are selected to allow the body and sleeve to move relatively to and between the desired positions, or in the case of the stabilizer shown, approximately 180 degrees of rotation between each position.

When the stabilizer is locked in the concentric mode, it will act as a conventional stabilizer. Also, when in this position, it doesn't matter whether it rotates with the drill pipe or the pipe rotates inside the stabilizer. When in the eccentric mode, however, the orientation of the stabilizer relative to the well bore is important and means are provided to orient the stabilizer in the desired direction.

In the embodiment shown, such means include annular piston 100 which is located in annular cavity 101 formed between tubular member 81 and tubular collar 102. Piston 100 is substantially of the same shape as piston 87 having outwardly extending flange 100*a* at its upper end to be engaged by the upper end of coil spring 103. The lower end of the coil spring is in engagement with inwardly extending flange 104 at the bottom of cavity 101. Spring 103, then, urges piston 100 upwardly to the position shown in FIG. 14B.

As best seen in FIG. 17, piston 100 is connected to the inner surface of flange 104 by longitudinally extending ribs or splines 100*b* that engage longitudinally extending grooves 104*b* on flange 104. Thus, piston 100 can move longitudinally of flange and collar 102, but cannot rotate relative thereto. The lower end of the piston extends into upwardly opening cavity 105 in the top of body 80. This portion of the piston carries outwardly extending protrusion or lug 106. This lug engages inwardly extending tang 107 connected to body 80 when piston 100 is in the upward position, as shown in FIG. 14B. With lug 106 and tang 107 in engagement, the body of the stabilizer will be locked to collar 102 which, as will be explained below, is connected to the drill string for rotation therewith. Therefore, when so locked together, the body of the stabilizer will rotate with the drill string.

To release the body for rotation relative to the drill string, piston 100 is moved downwardly by fluid pressure supplied through passageways 108 and 109 that are connected together through annular groove 110. Appropriate seals 111 are provided to isolate the fluid in the passageways.

Thus, means are provided through piston 100 and the inner engaging lug 106 and tang 107 to selectively lock the stabilizer for rotation with the drill pipe or to release the stabilizer to remain stationary relative to the drill pipe depending upon the relative position of the piston 100. This arrangement is used to maintain the stabilizer in the proper orientation when it is in the eccentric mode. To do this automatically, weight 112 is mounted for rotation along the longitudinal axis of the drill string with the center of gravity of its mass located on one side of the axis of rotation so that the weight will act as a pendulum and seek the low side of the hole. In the embodiment shown, weight or pendulum 112 is mounted for rotation by integrally attached in line cylindrical bosses **112*a* and 112*b* that are connected to mass or weight 112 at opposite ends. Cage 113 is located in the bore of member 81 with longitudinally spaced spiders 114 and 115. Bearings 116** carried by the spiders engage the bosses and serve as both thrust and rotary bearings to support the weight for rotation.

Extending through spider 115 is fluid passageway 118. This connects passageway 96 to passageway 108 to supply fluid to operate piston 100. Controlling the flow through passageway 118 is valve element 119. The valve element is supported for rotation between positions to open or close passageway 118 by valve rod 120 that extends through weight 112 along its axis of rotation. The upper end of rod 120 is connected to bushing 121 that is supported by the upper end of boss **112*a*. Pin 122 extends through both the bushing and the boss to fix the position of valve stem 120 and valve 119 with respect to weight or pendulum 112. In this way, the position of the pendulum or weight will determine whether or not valve 119 allows fluid pressure to travel through the passageways to move piston 100 downwardly to unlock the body of the stabilizer for rotation relative to the drill string. Since the drill string rotates relative to the weight, which will remain stationary on the low side of the hole, for each rotation of the drill pipe, valve 119 will be opened one time each revolution of the drill pipe. As shown in FIG. 14A, opening 119*a* appears to be straight through valve element 119, which would, of course, mean that the valve allows fluid to flow between passageways 118 and 108 two times during each revolution. Actually, however, passageway 119*a* is L-shaped, or at least not straight, so that in only one position will passageway 119*a* in the valve element allow fluid to flow through passageway 118**.

In operation, then, when no fluid under pressure is supplied to passageway 96, the stabilizer will automatically be locked in its concentric mode and operate as a conventional stabilizer rotating with the drill string. When it is desired to supply a lateral force to the drill string, pressure will be supplied to passageway 96 in any convenient manner, such as the system described in the patent identified above. When this occurs, piston 87 will move downwardly allowing the body and sleeve of the stabilizer to reorient themselves to move into the eccentric mode, whereby the sleeve will be exerting a lateral force on the drill string. At the same time, valve element 119 will become operative to control the flow of pressure fluid to actuate piston 100. By properly orienting the valve element with respect to the mass or pendulum 112, the valve element can be arranged to supply fluid pressure to move piston 100 downwardly during a particular segment of rotation of the drill pipe. Since the application of pressure to piston 100 causes the lug 106 on the piston to move out of engagement with tang 107 on the body, valve member 119 can be positioned to supply pressure fluid to the piston during the portion of each revolution that lug 106 would engage tang 107 if the stabilizer was properly oriented. In other words, referring to FIG. 17, if the stabilizer is in the desired position relative to the low side of the hole, we would want to move lug 106 into position not to engage tang 107 as it passes by the tang. Consequently, valve element 119 will be arranged to supply fluid pressure to move piston 100 downwardly, allowing lug 106 to move past tang 107 during this portion of the revolution of the drill pipe. After the lug has passed where tang 107 should be, the pressure, of course, will be shut off to the piston and lug 106 will return to the position to engage the tang. Consequently, this results in an automatic reorientation of the stabilizer with each revolution of the drill pipe, if this is required. This is important for, as explained above, when the stabilizer is in its eccentric mode, it must remain stationary with respect to the drill pipe. It will tend to drift, however, due to the tendency of the members to rotate with each other. Therefore, if we assume, for example, that the stabilizer does drift and moves to the position shown in dotted lines in FIG. 17, then as lug 106 makes its sweep it will pick up tang 107 and carry it with it as it rotates until it has moved the tang and the stabilizer back to the desired orientation where pressure will again be applied to piston 100 causing the lug to release the tang at that point.

Since the drill pipe may be rotated rather rapidly, there will be an impact between the lug and the tang each time that they engage. Therefore, means are provided to absorb some of the shock. In the embodiment shown, collar 102 is free to rotate relative to member 81. It is connected, however, to another collar 125 positioned directly above collar 102 by a plurality of vertically extending spring fingers 126. These fingers can be seen in FIGS. 18 and 19. The lower end of the fingers are rigidly connected to member 102. They extend upwardly into generally V-shaped groove 127 in member 125. The idea is that when lug 106 engages tang 107, the impact will be at least partially absorbed by bending spring fingers 126 to reduce the chance of damage to the members.

From the foregoing, it will be seen that this invention is one well adapted to attain all of the ends and objects hereinabove set forth, together with other advantages that are obvious and that are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A stabilizer for use with a drill string assembly in a well bore comprising a body supported by the drill string for rotation relative to the drill string and having a portion that is eccentric to the longitudinal axis of the drill string and a sleeve for engaging the walls of the well bore mounted for rotation on the body around an axis eccentric to the longitudinal axis of the body and means for limiting the relative rotation of the sleeve and the body between first and second positions in which the sleeve is eccentric of the longitudinal axis of the drill string in at least one of said positions, said body portion being eccentric of the longitudinal axis of the drill string the same amount as the axis of rotation of the sleeve is eccentric of the longitudinal axis of the body whereby the sleeve can be rotated relative to the body between said first position where the eccentricities of the body and the sleeve cancel and the longitudinal axis of the sleeve coincides with the longitudinal axis of the drill string and said second position where the eccentricities are cumulative to position the longitudinal axis of the sleeve the maximum distant from the longitudinal axis of the drill string, releasable means for holding the body and sleeve in one of said positions, said releasable holding means including latch means movable between a first position to stop the relative rotation of the body and sleeve when the sleeve and body are in said first position and a second position to stop the relative rotation of the body and sleeve when they are in said second position to exert a lateral force on the drill string, means to orient the stabilizer when in said second position to exert said lateral force in the desired direction, said orienting means including a weight, means mounting the weight for rotation around an axis parallel to the longitudinal axis of the drill string with its center of gravity offset from the axis of rotation so the weight will rotate to the low side of the drill string, means for connecting the sleeve and body to the drill string for rotation with the drill string and to release the sleeve and body when they are in the desired position relative to the weight to orient the stabilizer relative to the low side of the drill string to exert a lateral force in the desired direction.

2. The stabilizer of claim 1 in which the means for connecting and releasing the stabilizer and the drill string includes a lug carried by the drill string for rotation therewith and movable between a first position to engage a protrusion on the stabilizer to cause the stabilizer to rotate with the drill string and a second position where the lug will not engage the protrusion, and means for moving the lug to said second position when the lug is moving through the arcuate position occupied by the protrusion when the stabilizer is properly oriented relative to the weight.

3. The stabilizer of claim 1 in which the means for moving the lug to said second position includes means responsive to fluid pressure for moving the lug to one of said first and second positions and valve means controlled by the weight to supply fluid pressure to said lug moving means during the portion of a revolution of the drill pipe the lug is in said position.

4. a stabilizer for use with a drill string assembly in a well bore including a drill bit and a downhole motor for driving the drill bit comprising a body supported by the drill string for rotation therewith having portion that is eccentric to the longitudinal axis of the drill string, a sleeve for engaging the walls of the well bore mounted for rotation on the body, said sleeve having an eccentricity of rotation equal to the eccentricity of the eccentric portion of the body, and means for limiting the relative rotation of the body and sleeve between a first position where the eccentricity of the body is opposite the eccentricity of the sleeve to center the sleeve relative to the longitudinal axis of the drill string and a second position where the eccentricity of the body and the eccentricity of the sleeve combine to move the sleeve laterally of the longitudinal axis of the drill string to cause the sleeve to exert a lateral force on the drill string.

5. The stabilizer of claim 4 in which the body is circular in cross section and is mounted on the drill string with its longitudinal axis spaced from the longitudinal axis of the drill string a distance equal to the desired eccentricity of the eccentric portion.

6. The stabilizer of claim 4 in which the sleeve has longitudinally extending ribs on its outer surface to engage the walls of the well bore.

7. The stabilizer of claim 4 in which the sleeve and the body rotate relatively 180 degrees between the first and second positions.

8. The stabilizer of claim 4 further provided with means for moving the sleeve between the first and second positions including an arcuate cavity located between the body and the sleeve, a piston attached to the sleeve and positioned in the cavity for movement around the longitudinal axis of the body, means for stopping the movement of the piston in one direction when the sleeve and body are in the first position and for stopping the movement of the piston in the other direction, when the sleeve and body are in the second position, and means for supplying the cavity with fluid under pressure to move the piston and sleeve to the desired position relative to the body.

9. The stabilizer of claim 4 further provided with means to lock the body and sleeve in the desired position.

10. The stabilizer of claim 9 in which the locking means includes a locking member connected to one of the sleeve and body for rotation therewith, the other of said sleeve and body having first and second circumferential grooves that are longitudinally spaced apart and connected at each end with vertical grooves, and a locking pin carried by the locking member and extending into the grooves for movement to the end of the first groove to position the body and sleeve in the first position and to hold the body and sleeve in said position until it is moved vertically into the second groove for movement to the end thereof to position the body and sleeve in the second position, and means for moving the pin between the grooves when it is desired to move to another position.

11. The stabilizer of claim 10 in which the pin moving means includes an annular chamber located between the body and sleeve, a piston located in the chamber and connected to the locking member and means for supplying fluid under pressure to urge the piston and locking member in the direction to move the pin from the first to the second groove and means for urging the pin from the second groove to the first groove.

12. The stabilizer of claim 11 in which the means urging the pin toward the first groove includes resilient means located between the body and sleeve on the opposite side of the locking member from the piston.

13. The stabilizer of claim 11 in which the means urging the pin from the second groove to the first includes a second annular chamber located between the body and sleeve, a piston connected to the opposite end of the locking member and located in the second chamber, and means for supplying the second chamber with fluid under pressure to move the locking pin from the second to the first groove.

14. A stabilizer for use with a downhole motor drilling assembly, including a drill bit rotated by the motor, for selectively centralizing the assembly in the well bore or urging the assembly laterally to cause a change in the direction the bit is drilling comprising a body for mounting on the assembly above the bit for rotation with the assembly, said body having its longitudinal axis spaced from the longitudinal axis of the assembly, a sleeve for engaging the wall of the well bore mounted on the outer surface of the body for rotation relative thereto around the longitudinal axis of the body with the longitudinal axis of the sleeve spaced from the longitudinal axis of the body the same distance as the longitudinal axis of the body is spaced from the longitudinal axis of the assembly, means to limit the relative rotation of the sleeve and body between a first position where the longitudinal axis of the sleeve coincides with the longitudinal axis of the assembly to centralize the assembly in the well bore and a second position where the longitudinal axis of the sleeve is spaced from the longitudinal axis of the assembly for the sleeve to urge the assembly laterally.

15. The stabilizer of claim 14 in which the relative rotation of the sleeve and body between the first and second positions is approximately 180 degrees.

16. The stabilizer of claim 14 in which the means /limiting the relative rotation includes a lug carried by one of the body and sleeve and a groove located in the other of the body and sleeve to receive the lug and to limit the relative rotation of the sleeve and body to the movement of the lug between the ends of the groove.

17. The stabilizer of claim 14 further provided with means for moving the sleeve between the first and second positions including an arcuate cavity located between the body and the sleeve, a piston attached to the sleeve and positioned in the cavity for movement around the longitudinal axis of the body, means for stopping the movement of the piston in one direction when the sleeve and body are in the first position and for stopping the movement of the piston in the other direction, when the sleeve and body are in the second position, and means for supplying the cavity with fluid under pressure to move the piston and sleeve to the desired position relative to the body.

18. The stabilizer of claim 14 further provided with means to lock the body and sleeve in the desired position.

19. The stabilizer of claim 18 in which the locking means includes a locking member connected to one of the sleeve and body for rotation therewith, the other of said sleeve and body having first and second circumferential grooves that are longitudinally spaced apart and connected at each end with vertical grooves, and a locking pin carried by the locking member and extending into the grooves for movement to the end of the first groove to position the body and sleeve in the first position and to hold the body and sleeve in said position until it is moved vertically into the second groove for movement to the end thereof to position the body and sleeve in the second position, and means for moving the pin between the grooves when it is desired to move to another position.

20. The stabilizer of claim 19 in which the pin moving means includes an annular chamber located between the body and sleeve, a piston located in the chamber and connected to the locking member and means for supplying fluid under pressure to urge the piston and locking member in the direction to move the pin from the first to the second groove and means for urging the pin from the second groove to the first groove.

21. The stabilizer of claim 20 in which the means urging the pin from the second groove to the first includes a second annular chamber located between the body and sleeve, a piston connected to the opposite end of the locking member and located in the second chamber, and means for supplying the second chamber with fluid under pressure to move the locking pin from the second to the first groove.

22. A stabilizer for use with a drill string assembly in a well bore including a downhole motor for driving the drill bit comprising a body mounted on the drill string for rotation therewith and a sleeve for engaging the walls of a well bore mounted for rotation on the body, said body having a cam-shaped outer surface that engages the inner surface of the sleeve and moves the sleeve laterally of the longitudinal axis of the drill string when the body is rotated relative to the sleeve, the sleeve being mounted eccentrically on the body with an eccentricity equal to the throw of the cam-shaped outer surface of the body, and means for limiting the relative rotation of the body and the sleeve between a first position whereby the stabilizer will hold the drill pipe centered in the well bore and a second position whereby the stabilizer will urge the drill pipe laterally out of alignment with the center of the well bore.

23. A stabilizer for use with a drill string assembly in a well bore including a downhole motor for driving the drill bit comprising a body supported by the drill string for rotation therewith having a portion that is eccentric to the longitudinal axis of the drill string, a sleeve for engaging the walls of the well bore mounted for rotation on the body, said sleeve having an eccentricity of rotation equal to the eccentricity of the eccentric portion of the body, means for limiting the relative rotation of the body and sleeve between a first position where the eccentricity of the body is opposite the eccentricity of the sleeve to center the sleeve relative to the longitudinal axis of the drill string and a second position where the eccentricity of the body and the eccentricity of the sleeve combine to move the sleeve laterally of the longitudinal axis of the drill string to cause the sleeve to exert a lateral force on the drill string, and means for rotating the sleeve between first and second positions.

24. The stabilizer of claim 23 in which the sleeve moving means includes an arcuate cavity located between the body and the sleeve, a piston attached to the sleeve and positioned in the cavity for movement around the longitudinal axis of the body, means for stopping the movement of the piston in one direction when the sleeve and body are in the first position and for stopping the movement of the piston in the other direction, when the sleeve and body are in the second position, and means for supplying the cavity with fluid under pressure to move the psiton and sleeve to the desired position relative to the body.

25. A stabilizer for use with a drill string assembly in a well bore including a downhole motor for driving the drill bit comprising a body supported by the drill string for rotation therewith having a portion that is eccentric to the longitudinal axis of the drill string, a sleeve for engaging the walls of the well bore mounted for rotation on the body, said sleeve having an eccentricity of rotation equal to the eccentricity of the eccentric portion of the body, means for limiting the relative rotation of the body and sleeve between a first position where the eccentricity of the body is opposite the eccentricity of the sleeve to center the sleeve relative to the longitudinal axis of the drill string and a second position where the eccentricity of the body and the eccentricity of the sleeve combine to move the sleeve laterally of the longitudinal axis of the drill string to cause the sleeve to exert a lateral force on the drill string, and means to lock the body and sleeve in the desired position.

26. The stabilizer of claim 25 in which the locking means includes a locking member connected to one of the sleeve and body for rotation therewith, the other of said sleeve and body having first and second circumferential grooves that are longitudinally spaced apart and connected at each end with vertical grooves, and a locking pin carried by the locking member and extending into the grooves for movement to the end of the first groove to position the body and sleeve in the first position and to hold the body and sleeve in said position until it is moved vertically into the second groove for movement to the end thereof to position the body and sleeve in the second position, and means for moving the pin between the grooves when it is desired to move to another position.

27. The stabilizer of claim 26 in which the pin moving means includes an annular chamber located between the body and sleeve, a piston located in the chamber and connected to the locking member and means for supplying fluid under pressure to urge the piston and locking member in the direction to move the pin from the first to the second groove and means for urging the pin from the second groove to the first groove.

28. The stabilizer of claim 27 in which the means urging the pin from the second groove to the first includes a second annular chamber located between the body and sleeve, a piston connected to the opposite end of the locking member and located in the second chamber, and means for supplying the second chamber with fluid under pressure to move the locking pin from the second to the first groove.

* * * * *